United States Patent [19]

Zaremba

[11] 4,138,148

[45] Feb. 6, 1979

[54] SPLIT-RING RISER LATCH

[75] Inventor: Hubart B. Zaremba, London, England

[73] Assignee: Standard Oil Company (Indiana), Chicago, Ill.

[21] Appl. No.: 790,728

[22] Filed: Apr. 25, 1977

[51] Int. Cl.[2] ..... E21B 17/08; E21B 19/16; F16B 21/07; F16L 37/08

[52] U.S. Cl. ..... 285/317; 166/340; 285/39; 285/321; 285/DIG. 21; 285/DIG. 23; 403/15; 403/322

[58] Field of Search ..... 285/317, 321, 306, 308, 285/39, 27, 24, 18, DIG. 21, DIG. 23, 23, 277, 276; 294/86.24, 86.17, 86.15; 403/328, 324, 322, 31, 15; 166/0.6, 85; 92/61, 75

[56] References Cited

U.S. PATENT DOCUMENTS

| | | | |
|---|---|---|---|
| 2,743,781 | 5/1956 | Lane | 285/306 X |
| 3,193,308 | 7/1965 | Todd | 285/306 X |
| 3,420,148 | 1/1969 | Doerfer et al. | 92/61 X |
| 3,640,299 | 2/1972 | Nelson | 285/306 X |
| 3,929,355 | 12/1975 | Sljusar | 285/317 X |
| 3,944,273 | 3/1976 | Ahlstone | 294/86.24 X |

*Primary Examiner*—Mervin Stein
*Assistant Examiner*—Carl F. Pietruszka
*Attorney, Agent, or Firm*—John D. Gassett

[57] ABSTRACT

A latching and unlatching system for connecting a riser pipe to the casing in a subsea well. A split-circumferential ring fits into mating grooves in the male end of the casing and the female end of the riser. A releasing tool runs on a drill pipe suspended within the riser pipe and has a number of radially extendible pistons actuated by hydraulic pressure through the drill pipe to expand the split ring out of the casing groove to the grooved recess of the riser pipe. This releases the riser pipe from connection with the casing so it can then be raised.

9 Claims, 5 Drawing Figures

SPLIT-RING RISER LATCH

BACKGROUND OF THE INVENTION

Field of the Invention

The present invention relates to wells drilled in water-covered areas. It relates especially to a releasable connection between a casing cemented in a hole drilled in the water bottom and a riser pipe which extends from the casing to the water surface.

Setting of the Invention

In recent years, there have been a large number of oil and gas wells drilled in water-covered areas. The depth of the water may range from a few feet to a thousand or more. In these cases, the well is drilled in the ocean floor and a casing, which is a steel pipe of large diameter, is set and cemented in the wellbore. Sometimes the wells are completed on th bottom of the ocean floor. By "completed," it is meant that the wellhead, or the top, is capped at the ocean floor and arranged with various conduits and valves so that fluid may be produced from the well in a controlled manner. In many cases, however, it is desired to connect a riser pipe (e.g., a large diameter steel pipe) to the well casing in a sealing engagement thereto so, in effect, it extends the well casing to a floating vessel above the water's surface.

Prior Art

There are many couplings or connectors available for connecting a riser pipe to a subsea wellhead; for example, U.S. Pat. No. 3,241,864, issued Mar. 22, 1966, to C. D. Schaeffer, for an automatic connector. Another connector is described in U.S. Pat. No. 3,333,870, issued Aug. 1, 1967, to B. J. Watkins, for "Marine Conductor Coupling With Double Seal Construction." These connectors are considerably different from that which is described and claimed in my application. For example, I teach releasable actuating means which is actuated from within the inner casing. I know of no other marine conductor coupling which is releasable from within.

BRIEF DESCRIPTION OF THE INVENTION

This is a sealing releasable connector for the lower end of a marine riser pipe and the upper end of a casing string set in a subsea well. A latch pin is preferably provided on the upper end of the casing (although it might be on the lower end of the riser), and the latch box end is on the lower end of the marine riser pipe. Mating latching grooves are provided on the latch pin and inside the latch box. A latching element, such as a split ring, is provided in these mating grooves and is biased toward the pin. Releasing means operable from within the interior of the latch pin forces the latching ring out of the groove on the latch pin and into the groove recess of the latch box.

Preferably, the releasing means includes a plurality of ports extending through the wall of the pin and into the latching groove. Preferably, the releasing tool is a tool connected to the lower end of a drill string and includes a plurality of radially extensible pistons which, when the releasing tool is in place, are aligned with the ports in the latch pin. The application of hydraulic pressure through the drill pipe actuates these pistons and forces the split ring out of the groove on the latch pin of the casing. Then the riser pipe is released and may be raised from the casing.

DRAWINGS

A better understanding of the invention may be had from the following detailed description taken in conjunction with the drawings.

DETAILED DESCRIPTION OF THE INVENTION

Figure 1:
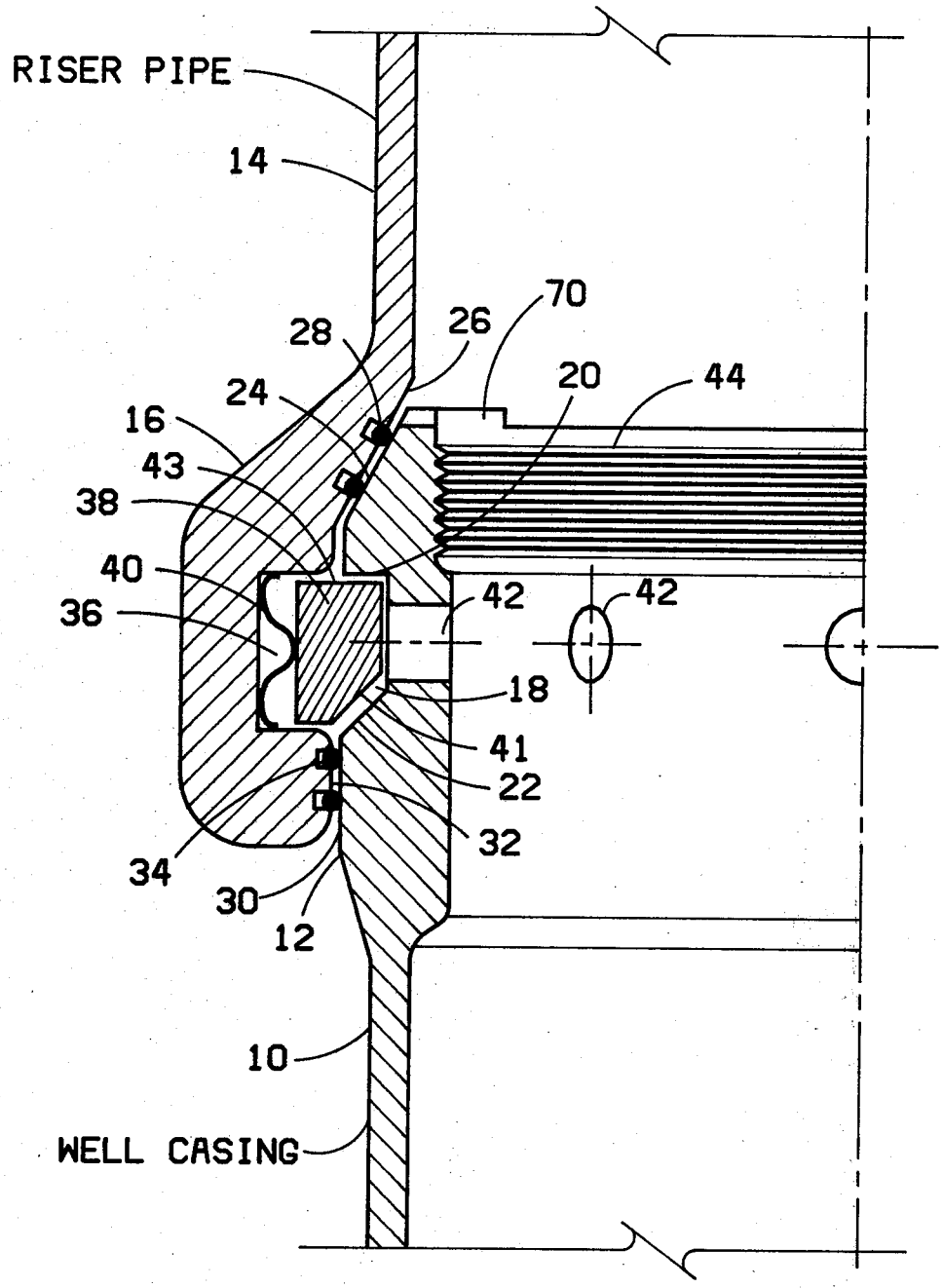
FIG. 1 illustrates the pin end of a subsea casing and the box end of the lower end of a riser pipe.

Attention is first directed to FIG. 1, which shows a well casing 10 having a special latch pin 12 and a riser pipe 14 having a special latch box 16. Pin end 12 has a circumferential latching groove 18 which extends circumferentially around it and has a downward facing upper shoulder 20, and a downwardly sloping shoulder 22. Pin latch 12 also has an upwardly facing shoulder 24 above groove 18.

Latch box 16 of the riser pipe has a downwardly facing shoulder 26 which mates with shoulder 24 of latch pin 12 when riser pipe 14 is in its lowest position. Seals 28 are provided between shoulders 24 and 26. Pin end 12 and latch box 16 can be made separately and welded or otherwise connected to casing 10 and riser pipe 14, respectively, or may be made integral therewith.

Latch pin 12 has a vertical surface 30 which mates with vertical shoulder 32 of latch box 16. Seals 34 are provided between surfaces 30 and 32 to obtain a fluid-tight seal between the well casing 10 and the riser pipe 14. The interior of latch box 16 has a circumferential groove 36 which mates with circumferential groove 18 of latch pin 12 when riser pipe 14 is in its lowermost position against the pin end 12 of the well casing. Mounted within grooves 16 and 18 is illustrated a split ring 38, which is urged or biased radially inwardly by spring means 40. Ring 38 has a lower sloping face 41 and an upper face 43 which is perpendicular to the axis of riser pipe 14. When riser pipe 14 is lowered, box 16 drops over pin 12 and pin shoulder 24 acts against ring 38 to force it outwardly. Once ring 38 has cleared shoulder 24, it "springs" inwardly and extends into pin groove 18. This locks pin 12 and box 16. Seals 34 provide a fluid-tight seal so that riser pipe 14 and casing 10 are effectively connected and sealed.

Also shown in FIG. 1 are a plurality of ports 42 which extend through the wall of latch pin 12 into circumferential groove 18. As will be seen, these are used in the releasing step or disengaging of split ring 38.

Figure 2:
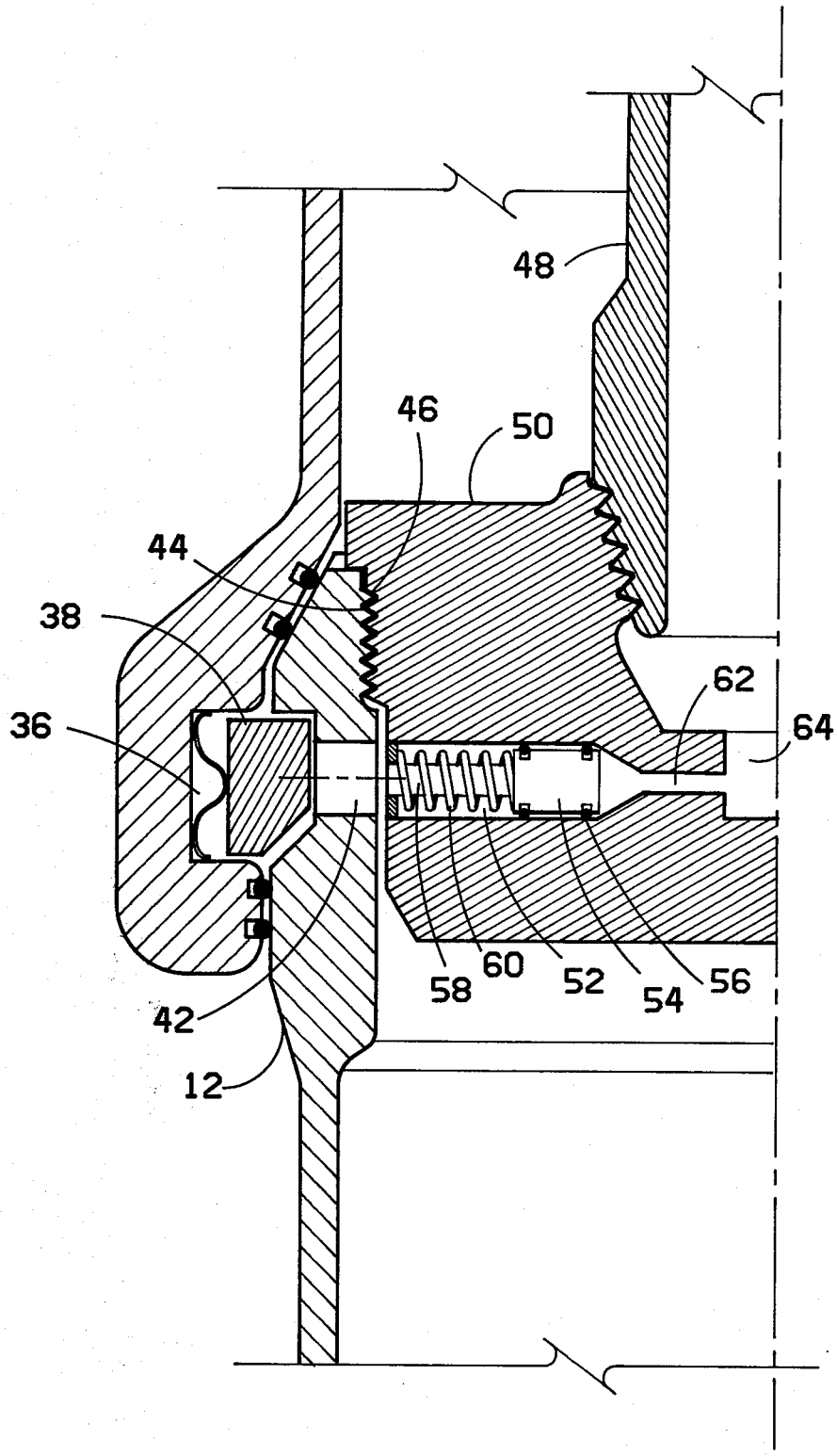
FIG. 2 is similar to FIG. 1 except that a releasing tool is shown positioned at the lower end of a drill string within the connected conduits.
Figure 3:
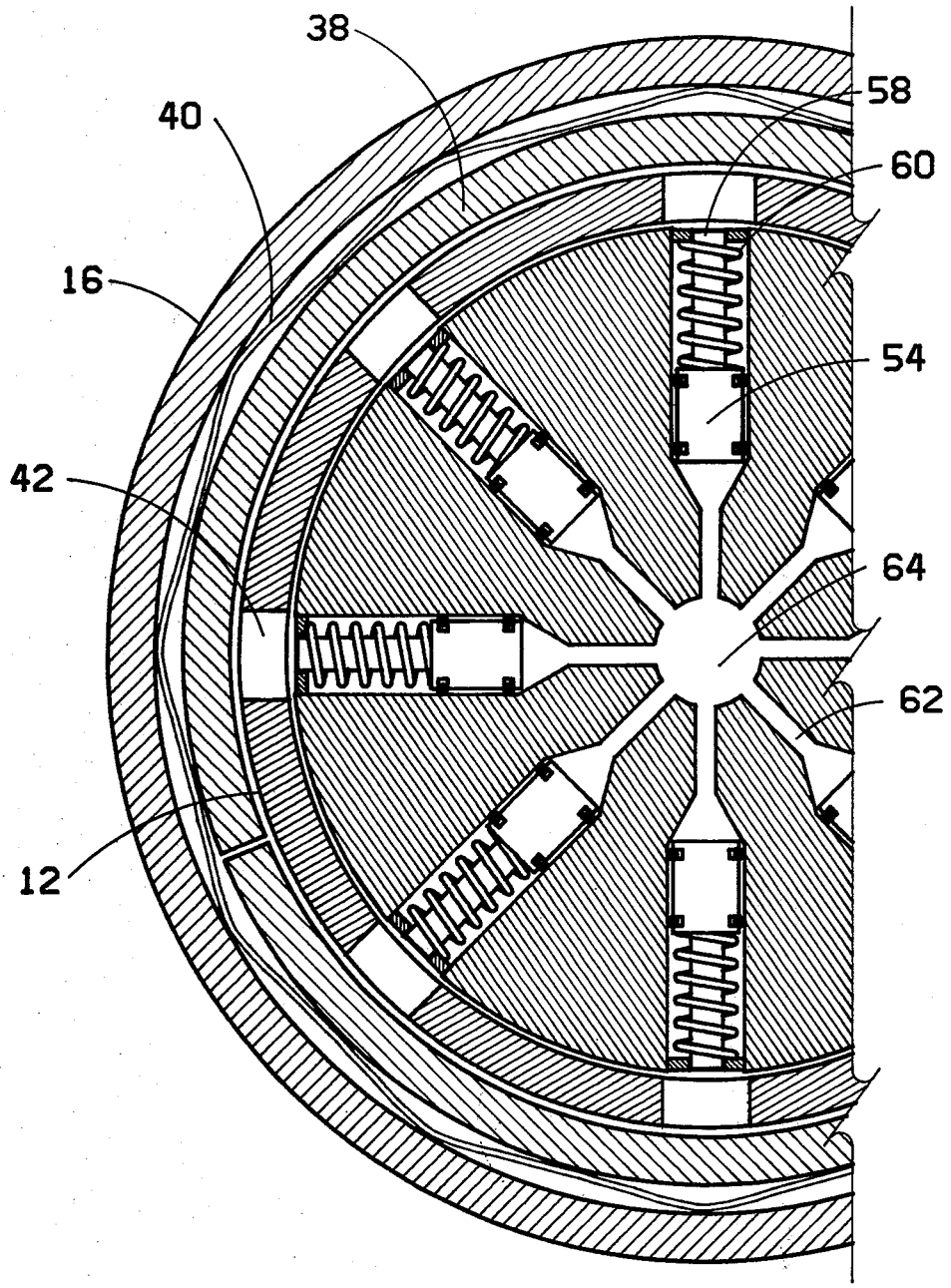
FIG. 3 is a view, partly in section, taken along the line 3—3 of FIG. 2.

Attention is now directed to FIGS. 2 and 3 which show releasing tool 50 which is connected to the lower end of a string of drill pipe 48. This has threads 46 which connect into threads 44 of the latch pin 12. A cylinder 52 is aligned with port 42 of pin 12. Mounted within cylinder 52 is a piston 54 having seals 56. Piston 54 has an extendible releasing rod 58. Piston 54 is biased toward the center of body 50 by springs 60. The power end of cylinder 52 is in fluid communication with the interior of drill pipe 48 through horizontal passage 62 and central chamber 64 of the member 50.

Figure 5:
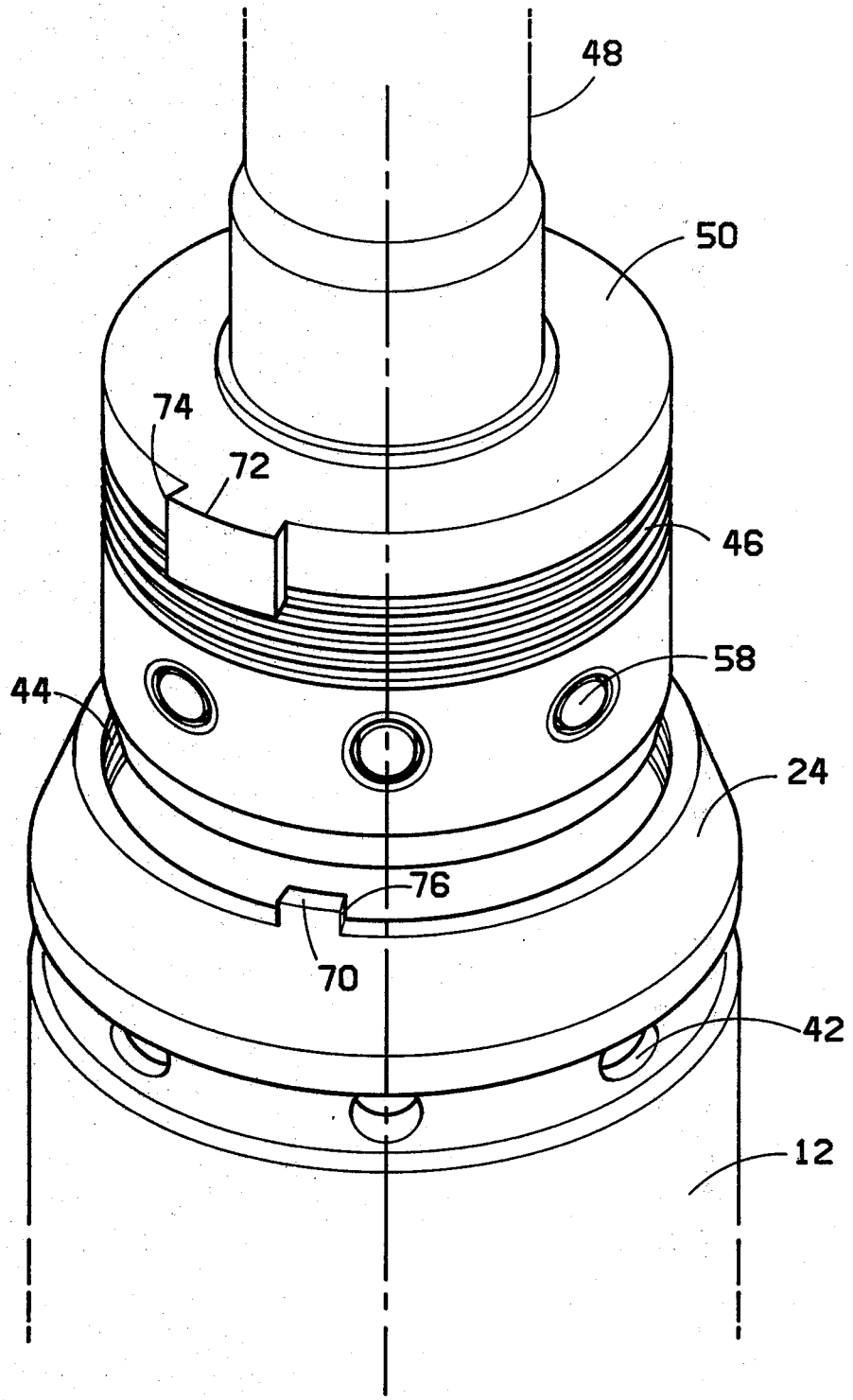
FIG. 5 illustrates orienting means to align the releasing tool with the pin member of the casing.

It is important that the pistons 54 be aligned with ports 42. A means of accomplishing this is shown in FIG. 5. As shown in FIG. 5, pin 12 has a block 70 mounted above threads 44. This has a face 76 which is a stopping face. Unlatching means 50 has a stop 72 having a stopping face 74. When unlatching means 50 is screwed into threads 44 of pin 12, the face of stop 72 abuts against face 76 of block 70. This stops the rotation of the unlatching tool 50. The tool has been designed and machined such that upon contact of block 70 and stop 72, releasing rods 58 of unlatching tool 50 are aligned with ports 42 of latch pin 12.

Figure 4:
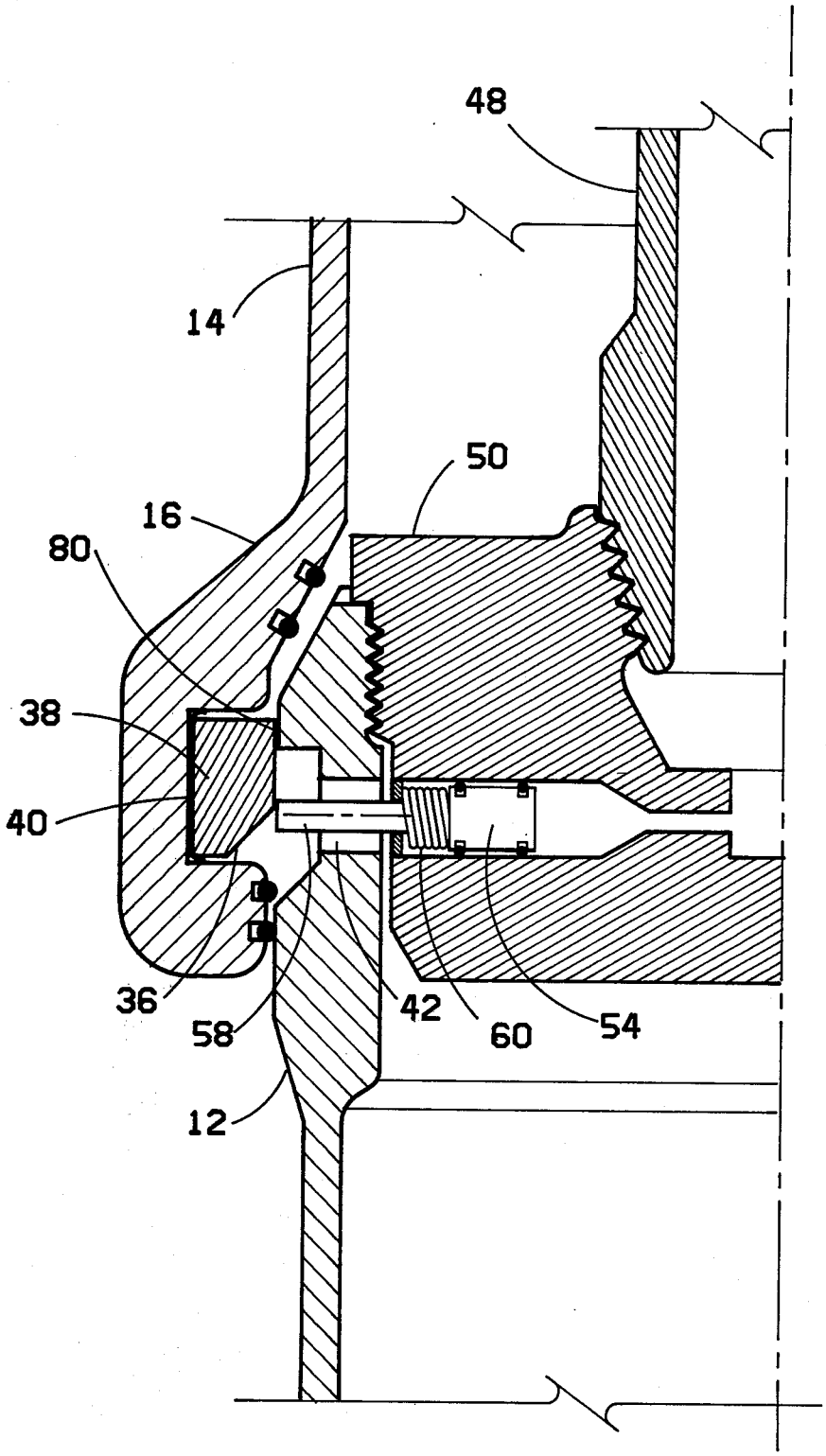
FIG. 4 is similar to FIG. 2 except that the releasing mechanism is shown actuated.

FIG. 4 illustrates the position of the various components when the box latch is released from the latch pin. Shown in FIG. 4 is an expanded split ring 38 which has been forced into groove 36 of the latch box 16 and completely out of pin groove 18 by the extension of releasing rod 58 of piston 54. Piston 54 is actuated by applying fluid under pressure through drill string 48, for example, from a floating vessel at the surface. As explained above in connection with FIG. 5, the extension pins 58 are aligned with ports 42. When the connector is released as shown in FIG. 4, riser pipe 14 is ready to be stripped up over drill pipe 48 or pulled up while pressure is maintained on piston 54. As may be seen in FIG. 4, the split ring 38 clears surface 80 of pin 12. At this point, the connector is unlatched. The riser pipe 14 is then pulled to the surface and replaced, repaired, or whatever may be necessary. Then, the releasing tool 50 is disconnected from pin 12, and raised to the surface. Merely releasing the pressure inside drill pipe 48 permits springs 60 to retract the piston so that piston extension rods 58 are clear of the box 12. If desired, a repaired or new riser pipe 14 can be lowered over box 12 and the latching means automatically locked. Thus, again the casing 12 and riser 14 become an integral, fluid-tight conduit.

While the above connector has been described in detail, various modifications thereto can be made without departing from the spirit or scope of the invention.

What is claimed is:

1. A releasable connector for connecting a lower end of a marine riser pipe and the upper end of a casing string set in a subsea well which comprises:

(a) a latch box (16) on the lower end of said riser pipe and having
  (i) a downwardly facing shoulder (26);
  (ii) an internal vertical cylindrical surface (32);
  (iii) a lock ring (38) carried in a latching groove in said latch box above said vertical surface;
  (iv) biasing means (40) urging said lock ring inwardly;

(b) a latch pin on said casing string and having
  (i) an outwardly facing vertical cylindrical surface (30) mating with said vertical cylindrical surface of said latch box;
  (ii) a latching groove (18) for receiving said lock ring when said inwardly facing vertical cylindrical surface of said latch box mates with said outwardly facing vertical cylindrical surface of said latch pin; and
  (iii) port means in and extending radially through the wall of said latch pin above said vertical cylindrical surface and extending to said latching groove of said latch pin.

2. A connector as defined in claim 1 including releasable means extensible from within said latch pin through said ports to force said lock ring out of said locking recess of said latch pin so that said box can be removed from said pin.

3. A releasable connector as defined in claim 2 in which said releasing means includes a cylindrical body fitting within said latch pin and having a plurality of pistons and cylinders radially aligned within said body, each said piston having an extension rod extensible through said port upon movement of said piston to force said lock ring out of said latching groove of said latch pin, and means connecting one end of said cylinder to a hydraulic power source.

4. A connector as defined in Claim 3 in which said means to connect said power end of said piston to a hydraulic source includes a drill string suspended within said riser pipe.

5. A connector as defined in claim 4 including an orienting means on said latch pin and said releasing body.

6. A releasable connector for connecting two conduits in a fluid-tight relationship which comprises:
  a latch box on one end of one conduit and having an internal cylindrical surface whose axis is the axis of said latch box;
  a latch pin on one end of the other conduit and having an external surface mating with said internal cylindrical surface of said latch box, an external latching recess, and port means extending radially through the wall of said latch pin into said latching recess; and
  an internal recess on said latch box having radially inwardly biased locking means therein.

7. A releasable connector as defined in claim 6, including releasable means extendible through said ports for releasing said locking means from said external recess.

8. A latch pin for connecting to a casing set in a subsea well which comprises:
  a tubular member having an outer sealing circumferential surface on one end and an inwardly sloping surface on the other end;
  a locking recess between said surfaces; and
  port means extending radially through the wall of said tubular member into said locking recess.

9. A releasing tool for connecting to the lower end of a string of drill pipe which comprises:
  a cylindrical body member;
  a central chamber in said body connectable to said drill pipe to be in fluid communication with the interior of said drill pipe;
  a plurality of cylinders in said body which are radially aligned, each opening to the external circumference of said body member;
  a piston in each said cylinder, each said piston having an outwardly extending releasing rod;
  mechanical means supported by said body biasing said piston inwardly;
  a passage for each said cylinder connecting the inner end of said cylinder with said chamber; and
  stop means on said body member at a fixed circumferential position with respect to each said cylinder.

* * * * *